United States Patent [19]

Lainio

[11] Patent Number: 5,005,488

[45] Date of Patent: Apr. 9, 1991

[54] METHOD FOR THE TRANSFER OF AN OVERHEAD CONVEYOR CARRIAGE FROM ONE TRACK ONTO ANOTHER AND AN OVERHEAD CONVEYOR SYSTEM

[75] Inventor: Kai Lainio, Turenki, Finland

[73] Assignee: Oy Partek Ab, Toijala, Finland

[21] Appl. No.: 435,278

[22] Filed: Nov. 13, 1989

[30] Foreign Application Priority Data

Nov. 11, 1988 [FI] Finland ..... 885227

[51] Int. Cl.[5] ..... B61B 3/02

[52] U.S. Cl. ..... 105/148; 105/149; 104/89; 104/96; 104/130

[58] Field of Search ..... 104/105, 130, 132, 96, 104/98, 89, 88, 111; 105/148, 154, 33, 156, 149, 152; 212/212, 211, 213, 223, 224, 242, 245, 248

[56] References Cited

U.S. PATENT DOCUMENTS

| | | | |
|---|---|---|---|
| 4,000,700 | 1/1977 | Hannover et al. | 104/130 |
| 4,203,369 | 5/1980 | Perrott | 104/130 |
| 4,213,396 | 7/1980 | Mehren et al. | 104/130 |
| 4,214,535 | 7/1980 | Gerhard | 104/130 |
| 4,561,359 | 12/1985 | Duce | 104/94 |

FOREIGN PATENT DOCUMENTS

| | | | |
|---|---|---|---|
| 2243032 | 3/1974 | Fed. Rep. of Germany . | |
| 2617780 | 11/1976 | Fed. Rep. of Germany | 104/130 |
| 1354888 | 5/1974 | United Kingdom | 104/130 |

*Primary Examiner*—Robert J. Oberleitner
*Assistant Examiner*—Mark T. Le
*Attorney, Agent, or Firm*—Burns, Doane, Swecker & Mathis

[57] ABSTRACT

A device for the transfer of an overhead conveyor carriage (1) from one track (4) onto another track (4A) in an overhead conveyor system. The transfer takes place by altering the height positions of the wheels in relation to the track (4). An overhead conveyor carriage (1) that is provided with two sets of transfer wheels (9) placed at a transverse distance from each other is brought to a track-exchange area, where a first track (4) and a second track (4A) are placed at a specified distance in parallel to each other. The height positions of the sets of transfer wheels (9) of the conveyor carriage (1) placed facing the first track (4) and the second track (4A) are altered in such a way that the wheel sets (9) in the carrying position are detached from the first track (4) and the wheel sets (10) in the detached position are placed into the carrying position on the second track (4A).

18 Claims, 15 Drawing Sheets

METHOD FOR THE TRANSFER OF AN OVERHEAD CONVEYOR CARRIAGE FROM ONE TRACK ONTO ANOTHER AND AN OVERHEAD CONVEYOR SYSTEM

BACKGROUND OF THE INVENTION

1. Field of the Invention

The present invention concerns a method for the transfer of an overhead conveyor carriage, which has been brought to the track-exchange area, from one track onto another by altering the height positions of the transfer wheels of the conveyor carriage in relation to the track. The invention also concerns an overhead conveyor system comprising a network of conveyor tracks and one or several conveyor carriages provided with transfer wheels, the network of conveyor tracks including track-exchange areas. The overhead conveyor system is particularly well suited, e.g., for the transfer of plate-shaped construction units cast of concrete between various processing points in the production plant.

2. Description of the Related Art

In the prior art, among other things, the overhead conveyor system described in the publication DE 2,243,032 includes a projecting rail, which is mounted on the conveyor carriage, which pivots around a vertical shaft, and on which an electric hoist can be run to the side of the conveyor carriage proper so as to engage or disengage a load. Thus, said prior-art system permits operation of the conveyor within a zone wider than the track line.

Also, in the prior art, an overhead conveyor system in accordance with the patent EP 0,110,196 (U.S. Pat. No. 4,561,359) is known, which is mainly suitable for the transfer of rather low-weight loads which can be lifted by hand. In said system the conveyor carriage can be suspended by its wheel sets between two parallel rails placed one above the other and, correspondingly, be detached from between the rails by altering the position of the suspension wheel sets by means of a vertical movement applied to the conveyor carriage and rotating the wheel sets around a horizontal axis. The downward movement that locks the wheel sets takes place by the effect of the weight of the carriage and of the load, and the upward detaching movement takes place by the effect of lifting by hand.

The method in accordance with the present invention is mainly characterized in that an overhead conveyor carriage that is provided with two sets of transfer wheels placed at a transverse distance from each other is brought to the track-exchange area, where a first track and a second track are placed at a specified distance and as parallel to each other, and that the height positions of the sets of transfer wheels of the conveyor carriage placed facing the first track and the second track are altered in such a way that the wheel sets in the carrying position are detached from the first track and the wheel sets in the detached position are placed into the carrying position on the second track. The conveyor system in accordance with the invention is characterized in that, in the track-exchange areas, the first track and the second track are placed side by side at a certain distance from each other and both of said tracks have running faces consisting of two guide rails placed at different heights, that the conveyor carriages are provided with two sets of transfer wheels placed at a transverse distance from each other, in which said wheel sets the wheels can be fitted into a grasping position against the running faces of the guide rails of either one of the tracks, and that the height positions of the sets of transfer wheels can be alternated between the grasping position and the detached position.

Advantages of the present invention over the invention in accordance with DE 2,243,032 are as follows:

- no track switches are needed at the junction points between the alternative tracks (see DE 2,243,032, FIG. 1),
- when a load is transferred from one working site to the other, the lifting hook does not have to be coupled and uncoupled by hand in between,
- a possibility to transfer loads in narrow spaces lengthwise while suspended from two points,
- less heavy track support constructions, because no pivoting projection rail with heavy counterweight to permit lateral shifting is needed,
- three separate running rails are not needed.

In respect of its operations, the system of the patent EP 0,110,196 does not correspond to the system in accordance with the present invention, nor is it usable for the purposes of use described in the specification of the present invention.

In the overhead conveyor system in accordance with the present invention, by shifting the centre of gravity of the load and of the conveyor carriage horizontally in the transverse direction and by exchanging the positions of the sets of transfer wheels, alternatively grasping the adjoining running tracks, with each other, the conveyor carriage moving along a stationary conveyor track, together with the load that it has picked up, can be made to move onto the adjoining side track for the purpose of bypassing. If necessary, the conveyor carriage may also be made to "jump" onto another track, placed at the side in the location concerned, in other cases, as is chosen, without any track switch member that alters its position of operation or that it otherwise displaceable.

The accompanying FIGS. 1 to 18 illustrate an overhead conveyor system in accordance with the present invention:

DESCRIPTION OF THE PREFERRED EMBODIMENTS

Figure 1:
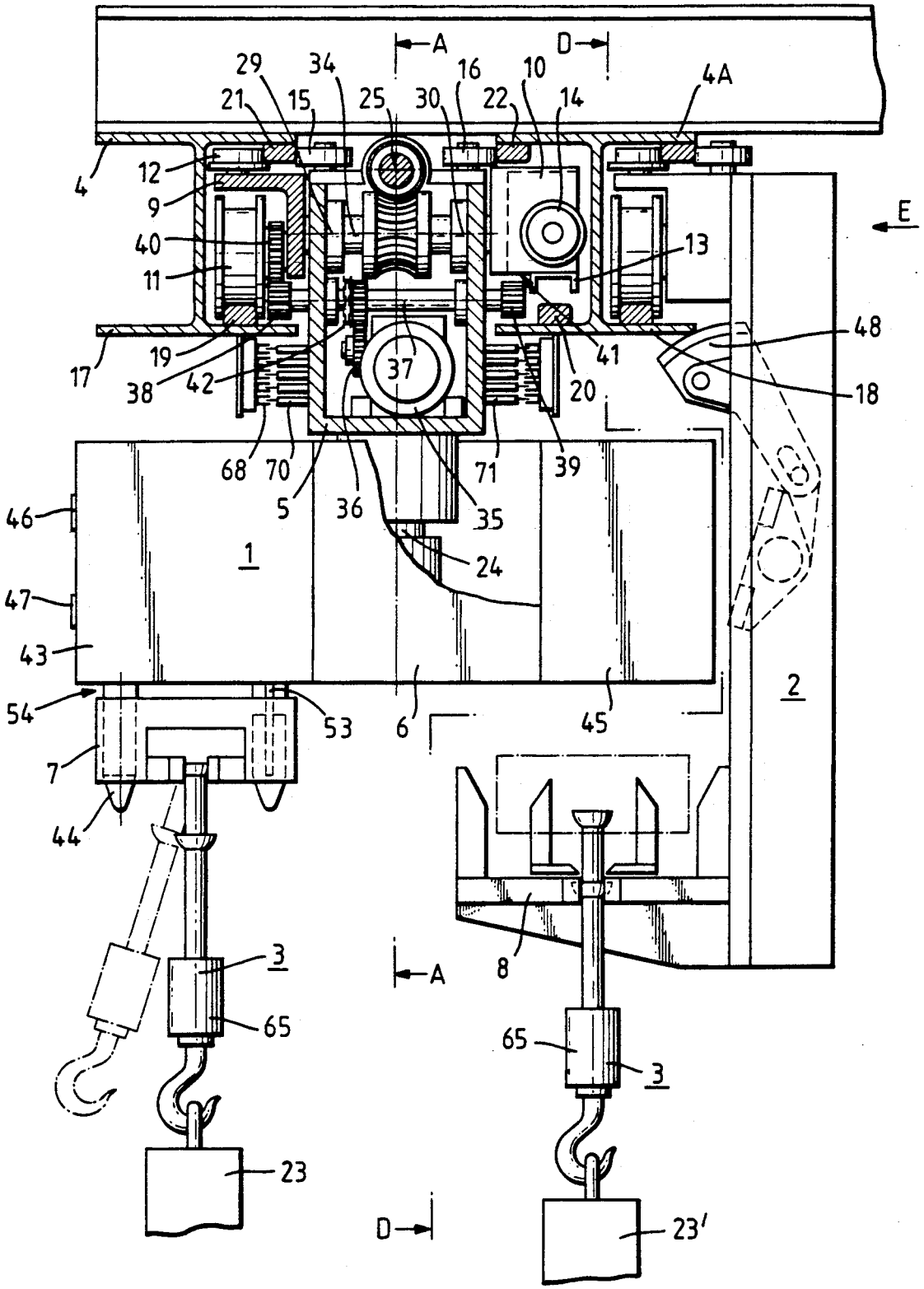
FIG. 1 is an end view of a conveyor carriage and a displaceable suspension member placed at a working site, the conveyor carriage being shown as a section taken along the line B—B in FIG. 2.
Figure 2:
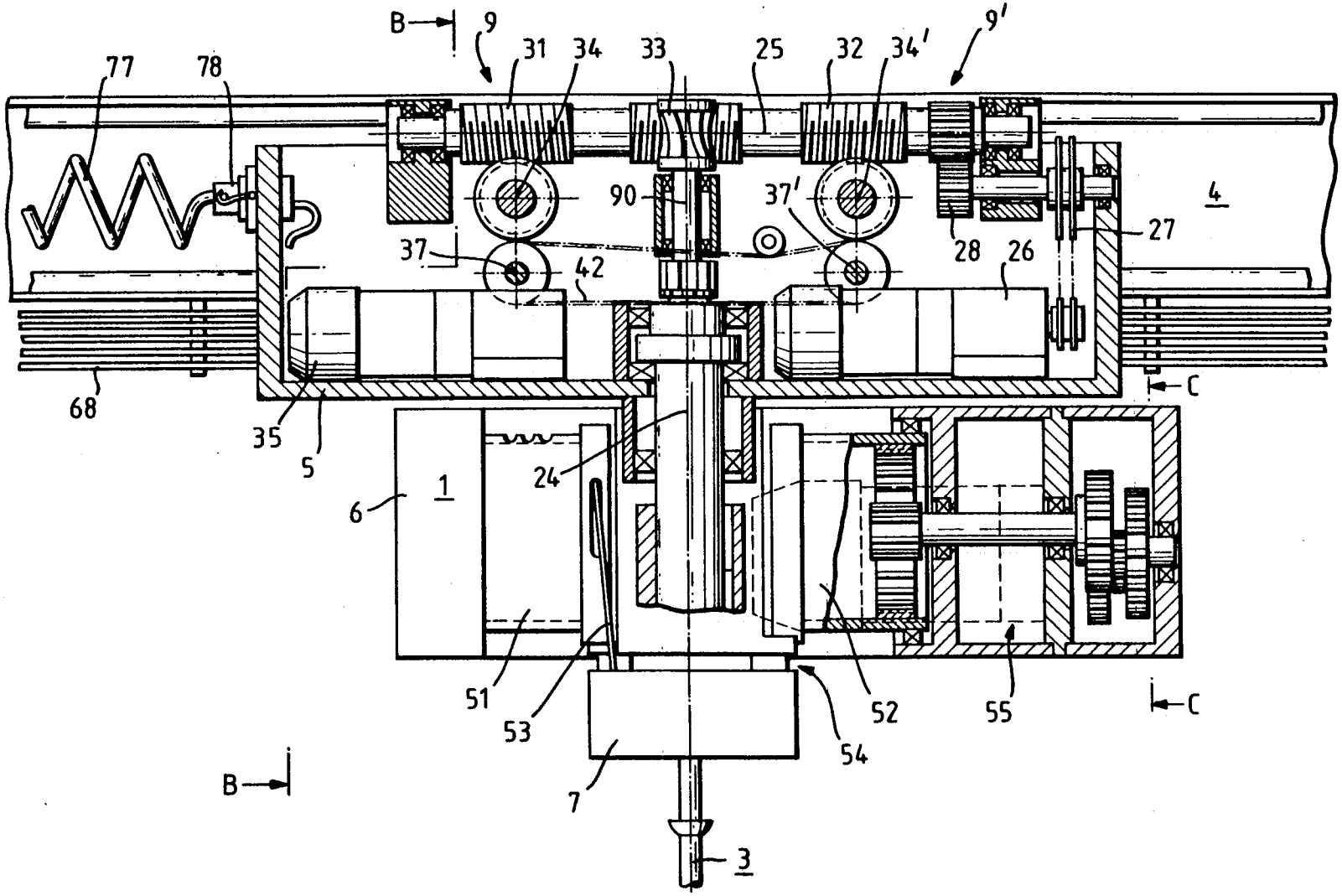
FIG. 2 is a longitudinal sectional view taken along the line A—A in FIG. 1, the transmission gearing of the hoist part placed further back being additionally shown with the casing cut-off.

The system in accordance with the present invention consists of one or several conveyor carriages 1, of suspension members 2, of hook units 3, as well as of tracks 4, 4A, 4B. The conveyor carriage 1 consists of a transfer unit 5 and of a hoist unit 6, which is provided with the grasping member 7 of the conveyor carriage. In a corresponding way, the suspension member 2 is provided with the grasping member 8 of the suspension member. The suspension members 3 may be either provided with wheels, displaceable by means of the conveyor carriage 1 along the rail 4A, or suspension numbers may be stationary.

The transfer unit 5 of the conveyor carriage 1 comprises wheel sets 9, 9' and 10, 10' placed one after the other at each of its sides. Of these wheel sets, those placed at either one of the sides are in the carrying position. The wheel sets 9, 9' run along the rail 4, or alternatively the wheel sets 10, 10' run along the rail 4A or 4B. The wheels in the wheel sets 9 and 9' and 10, 10' can be raised and lowered, and in this way the wheel sets placed at either one of the sides can be chosen for the carrying position.

The hoist unit 6, which is placed below the transfer unit 5, can be turned around a vertical shaft 24. By means of the turning movement, firstly, the centre of gravity of the unit consisting of the conveyor carriage and of the load can be shifted in order that the support could be made stable irrespective of which side's wheel sets 9, 9' or 10, 10' are used for the carrying.

By turning the hoist unit 6, the grasping member 7 of the conveyor carriage together with its load 23 can also be shifted to the side to a sufficient extent so that, if necessary, other loads 23', hanging from the suspension members 2 carried on the outer flange of the same track 4A, can be by-passed.

Moreover, by means of the turning movement of the hoist unit 6, if necessary, the grasping member 7 of the conveyor carriage 1 can be shifted to above the grasping member 8 of the suspension member 2. Thereby the hook 3 with the load 23 can be lowered from the grasping member 7 of the conveyor carriage onto the grasping member 8 of the suspension member, and the other way round.

In FIG. 1, a meeting zone of the tracks 4 and 4A is seen, where the I-section rails 17 and 18 run side by side as parallel to each other. The flanges of the rails 17 and 18 facing each other are provided with guide rails 19, 21 and 20, 22. The lower guide rails 19 and 20 are attached to the upper faces of the lower flanges of the I-section rails, facing each other, and the upper guide rails are attached to the lower faces of the upper flanges of the I-section rails, facing each other. In this way two C-section furrows opening towards one another have been formed.

By means of their individual wheels 11, 12 and 13, 14 as well as by means of the auxiliary wheels 15, 16, the transfer wheel sets 9, 9' and 10, 10' grasp the lower guide rail 19 and the upper guide rail 21 attached to the I-section rail 17 accurately, or, alternatively, they grasp the corresponding guide rails 20, 22 of the I-section rail 18 at the other side, depending on to which I-section rail's 17, 18 side the grasping member 7 of the conveyor carriage, together with its hook unit 3 and load 23, has been turned by means of the shaft 24.

The vertical shaft 24 and the transfer wheel sets 9, 9' and 10, 10' are mechanically interconnected through a longitudinal drive shaft 25. The drive shaft 25 is driven by an electric switching motor 26 via a chain-pulley transmission 27 and a cogwheel transmission 28. The transfer wheel sets 9, 10 pivot on bearings 29, 30, which are placed eccentrically in relation to the shafts of the carrying wheels 11, 13. The carrying wheels 11, 13 are also eccentric in relation to one another. The wheel 12 is attached to the wheel set 9 so that its shaft is placed facing the wheel 11, being parallel to the radius of the wheel 11. In its upper position, with the shaft in the vertical position, the wheel 12 runs along the vertical face of the upper guide rail 21. Correspondingly, the shaft of the wheel 14 in the wheel set 10 is placed facing the wheel 13, parallel to the shaft of the wheel 13. The shafts of the wheels 12 and 14 are at an angle of 90° relative one another. The carrying wheel 13 included in the transfer wheel set 10 at the side that is in the detached position at the time of examination is in a detached position having risen apart from its guide rail 20, and the shaft of the wheel 14 is in the horizontal position. The vertical dimension of the wheel set placed in the detached position is smaller than the gap between the guide rails 20, 22 placed one above the other. In such a case, said transfer wheel set 10 is readily removed from the space formed by the I-section rail 18 and by the guide rails 20, 22 towards the side at a point in the track 4 where the rails 17, 18 become more distant from each other in the running direction.

By means of wormgear transmissions 31, 32, 33 the same drive shaft 25 operates both the transfer wheel sets 9, 10; 9', 10' and the shaft 24 that turns the hoist unit 6. The transfer wheel sets 9, 10 and 9', 10' at each side are interconnected in pairs by means of the shafts 34, 34'.

The turning movement for shaft 24 for the hoist unit 6 is taken from the drive shaft 25 through an auxiliary shaft 90 mounted on the frame and placed at the side of the centre line of the drive shaft 25.

The transfer unit 5 receives its running power from an electric switching motor 35, which, through cogwheels 36, rotates the shaft 37, whose ends are provided with cogwheels 38, 39. The carrying wheels 11, 13 are provided with corresponding cogwheels 40, 41, which engage the cogwheels 38, 39 when said transfer wheel set 9, 9' or 10, 10' is in its grasping position and the corresponding carrying wheel 11 or 13 is at its lowest point. The shaft 37 is connected by a chain transmission 42 to a corresponding shaft 37' which drives the carrying wheels 11', 13' at the other end.

Figure 8:
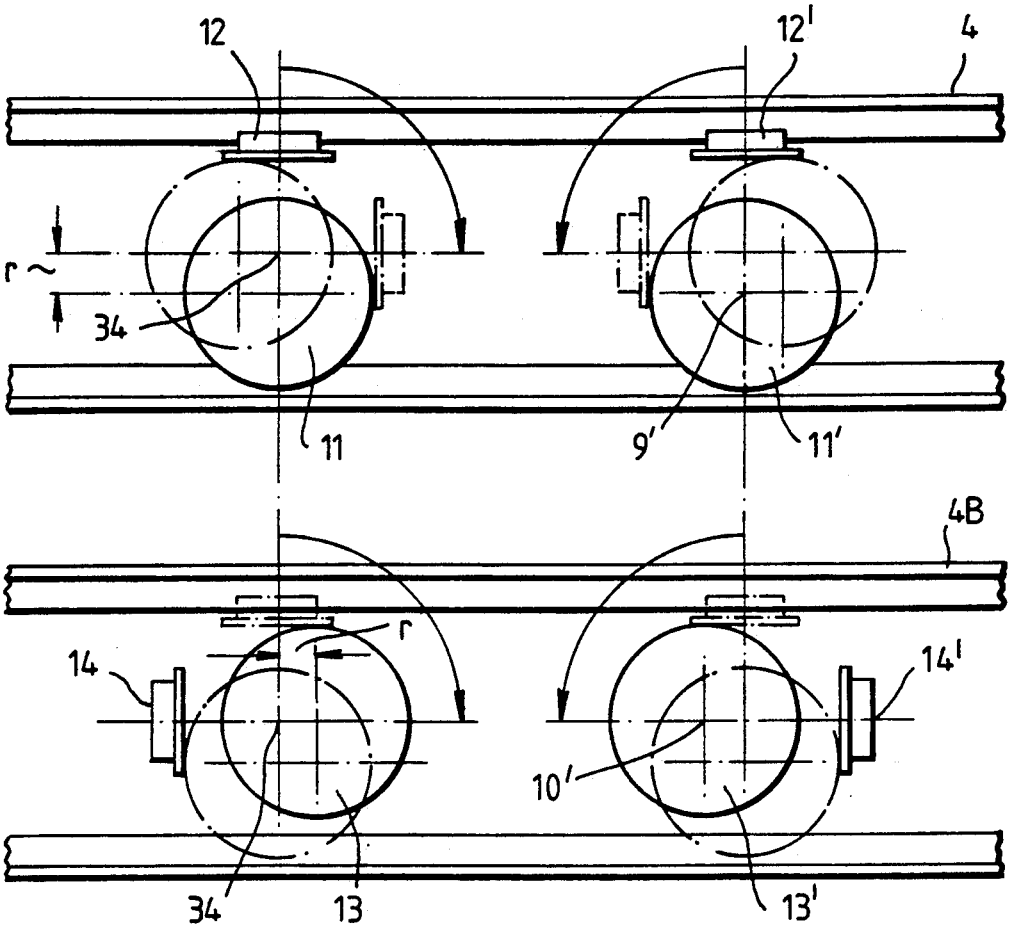
FIG. 8 shows positions of the wheel sets in the conveyor carriage seen from the direction E shown in FIG. 1, FIGS. 9 and 10 show alternative solutions for the wheel sets of the conveyor carriage.

A change of track is carried out by interchanging the positions of the transfer wheel sets 9, 9' and 10, 10' by rotating the shafts 34, 34' over 90°, said rotation taking place by means of self-holding screw transmissions 31, 32. This movement of rotation is shown in FIG. 8 in respect of all of the wheel sets 9, 9', 10, 10'. The full lines denote the wheel sets 9 and 9' in the carrying position and the wheel sets 10 and 10' in the detached position. The dashed-dotted lines denote the 90°-rotated positions, whereby the functions of the wheel sets have been reversed. When the track is changed, the conveyor carriage 1 has to be lowered a few millimeters before the transfer wheel sets at the other side are locked in their carrying positions. This determines the torque of the electric switching motor 26 which drives the drive shaft 25 as well as the lateral elastic play of the current collectors 70, 71.

The hoist unit 6 comprises a cable hoist 43 proper with its guide pins 44 as well as an electric control unit 45. The hoist unit 6 further comprises activation pins 46, 47 displaced axially by a solenoid for engaging and disengaging a friction brake catch 48 provided in a suspension member 2 provided with wheels.

The cable hoist 43 differs from a conventional cable hoist in the respect that it is provided with two cable drums 51, 52 revolving in opposite directions so as to arrange the lifting cables 53, 54 appropriately in relation to the safety grasper 7 of the conveyor carriage. Since the lifting distance required is short, the lengths of the cables 53, 54 and of the cable drums 51, 52 are also short, and the lifting speed is relatively low and the hoist motor 55 is relatively small.

Figure 5:
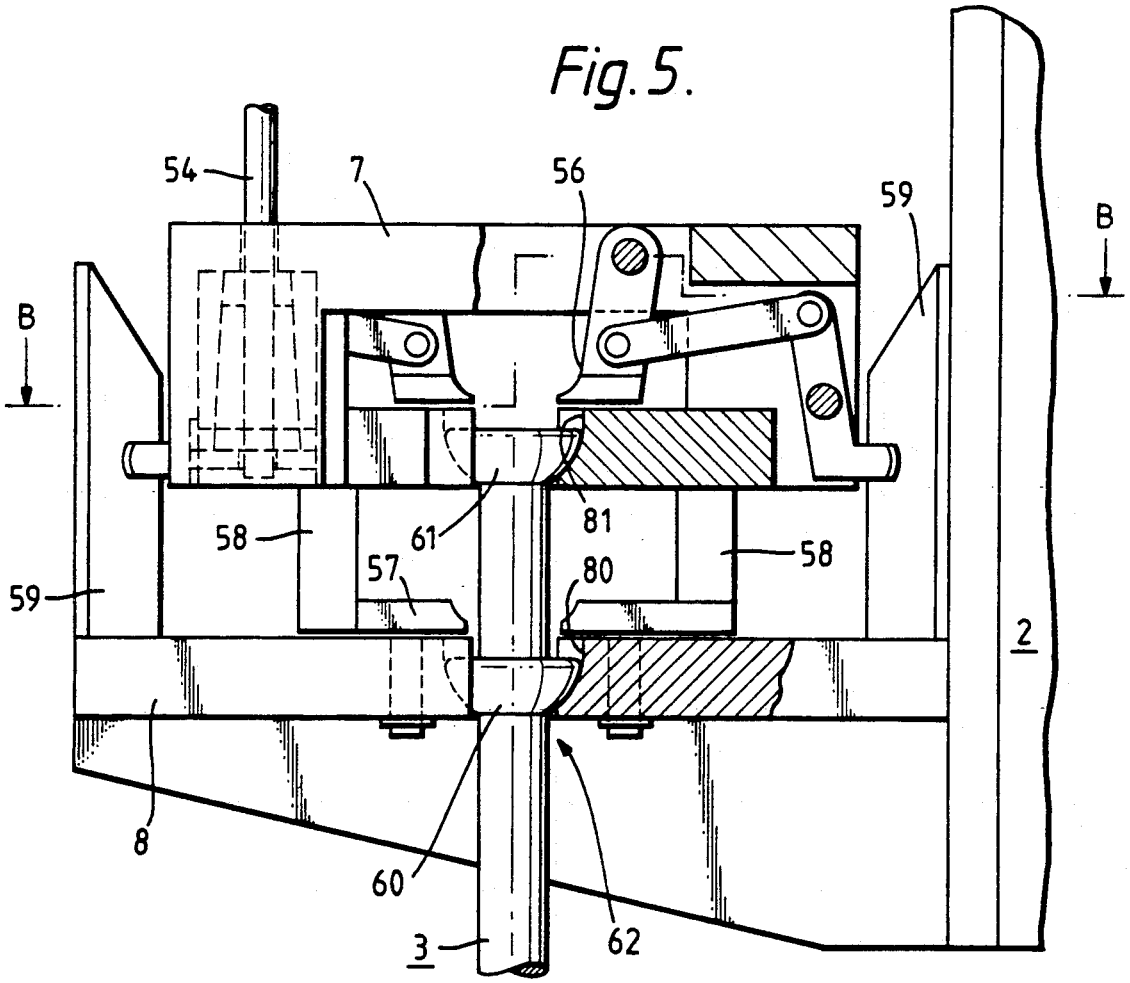
FIG. 5 is a sectional end view of the conveyor carriage and of the grasping members of the suspension member taken along the line A—A in FIG. 6.
Figure 6:
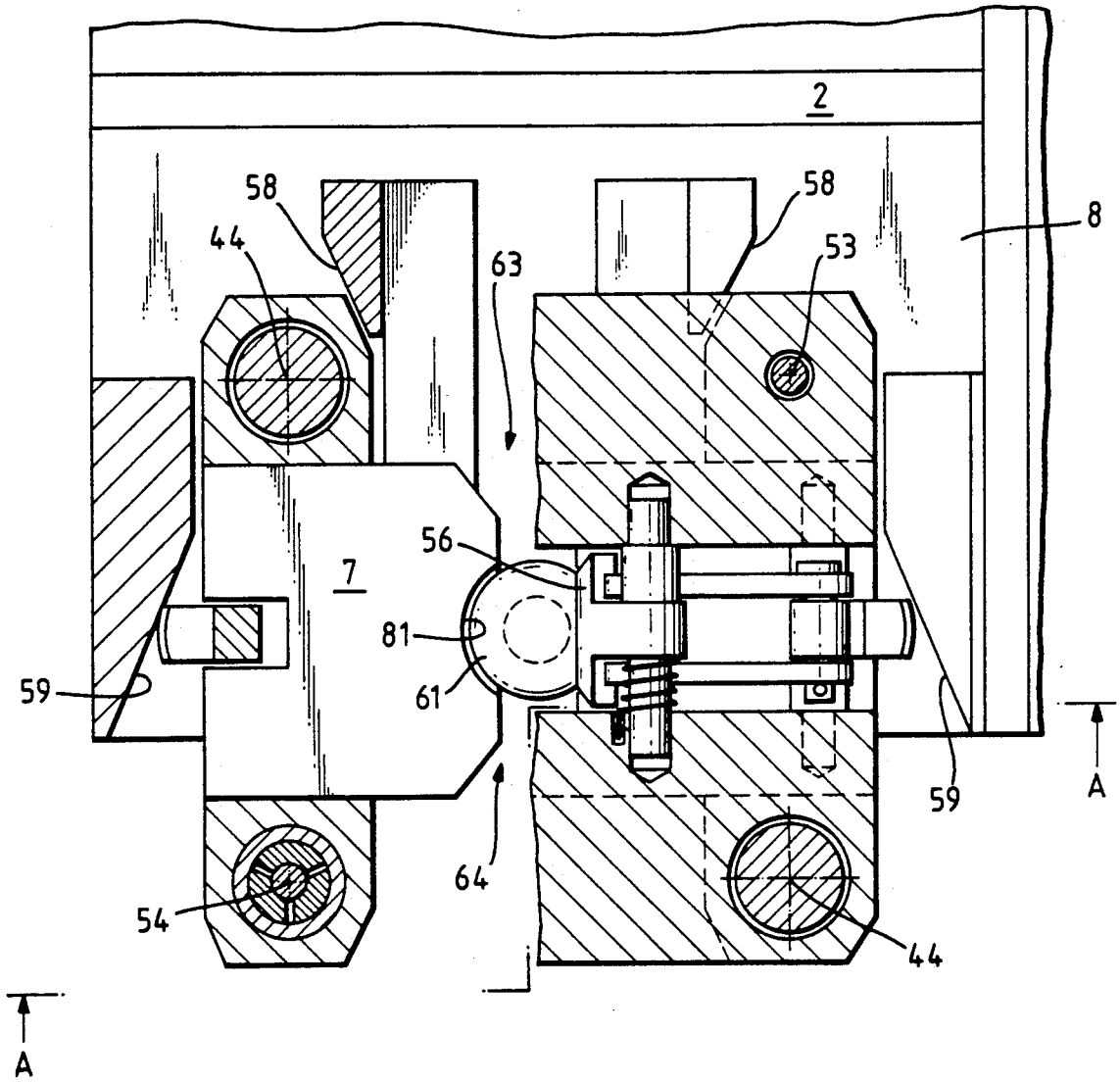
FIG. 6 is a sectional top view of a grasping member of the conveyor carriage taken along line B—B in FIG. 5.
Figure 7:
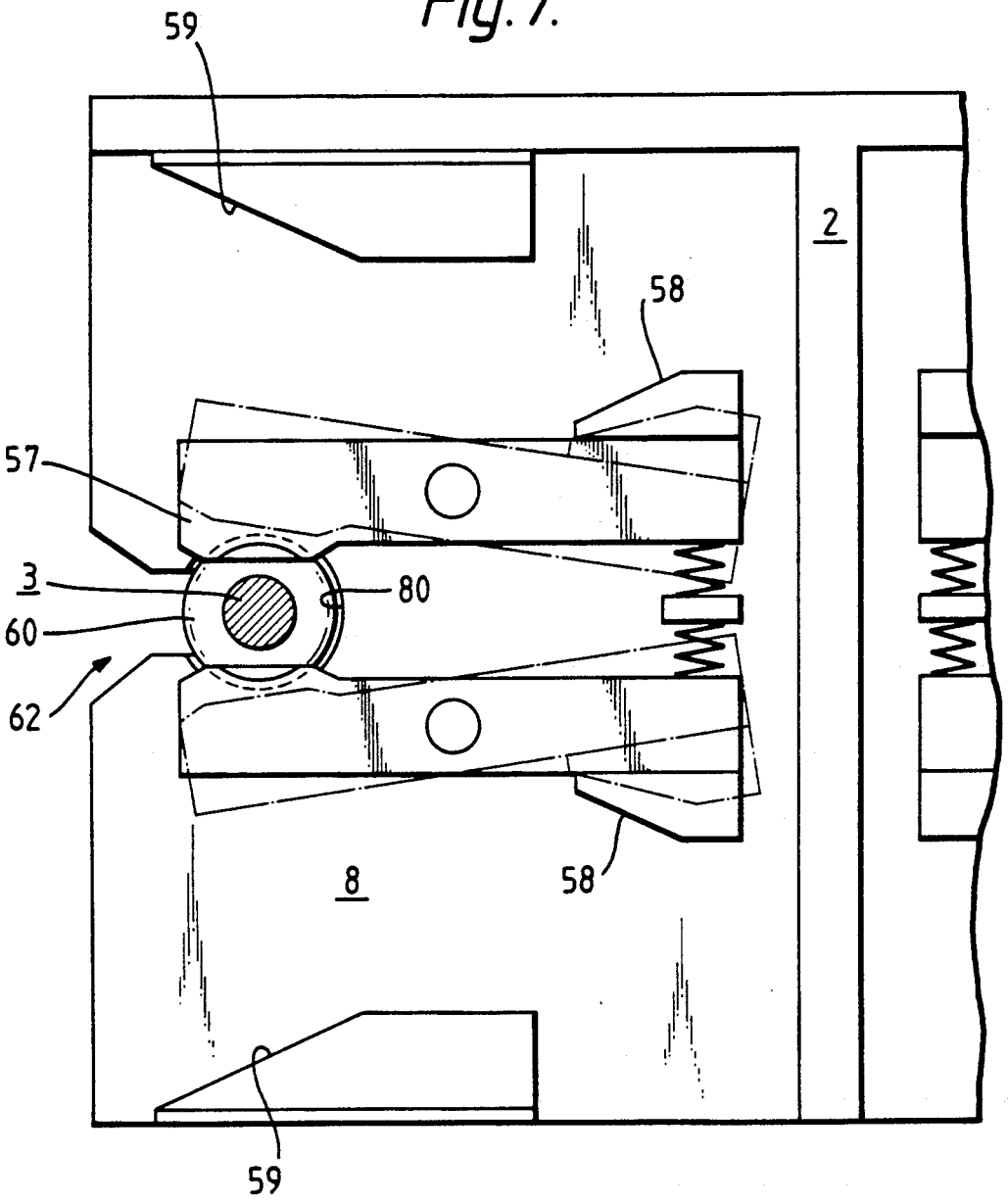
FIG. 7 is a top view of a grasping member of a suspension member.

The safety grasper 7 of the conveyor carriage 1 and the safety grasper 8 of the suspension member 2 are provided with such safety catches 56, 57 (FIGS. 5 to 7) which are closed by spring force and are opened when the safety graspers are brought to locations facing them. The safety grasper 7 of the conveyor carriage opens the safety catch 57 of the suspension member, and the other way round. The safety catch 57 is opened by the wedges 58 provided therein, having been pushed together by the grasper 7, and the safety catch 56 is opened by the wedges 59.

On the arm of the hook unit 3 there are two projecting grasping points 60 and 61 placed one above the other. The grasping member 8 of the suspension member is provided with a socket 80, into which the lower grasping point 60 fits, and correspondingly the grasping member 7 on the conveyor carriage is provided with a socket 81, into which the upper grasping point 61 fits. When the safety catches 56, 57 are open, the safety grasper 7 of the conveyor carriage is capable of lifting the lower grasping point 60 of the hook unit 3 to above the safety catch 57, in which case the hook unit 3 can be removed out of the suspension member 2 by shifting the conveyor carriage 1 on its rails and by shifting the hook 3 away from the groove 62. In a corresponding way, by lowering the safety grasper 7 the upper grasping point 61 can be brought to above the safety catch 56, whereby movement of the conveyor carriage 1 in any direction makes the hook unit 3 free to rest on the suspension member 2. The safety grasper 7 of the conveyor carriage is provided with grooves 63, 64 opening forwards and rearwards.

In order that the load 23 should not be rotated when the hoist unit 6 is rotated from one position to the other, i.e. 180° around the vertical axis, the hook unit has a freely revolving bearing assembly 65.

Figure 3:
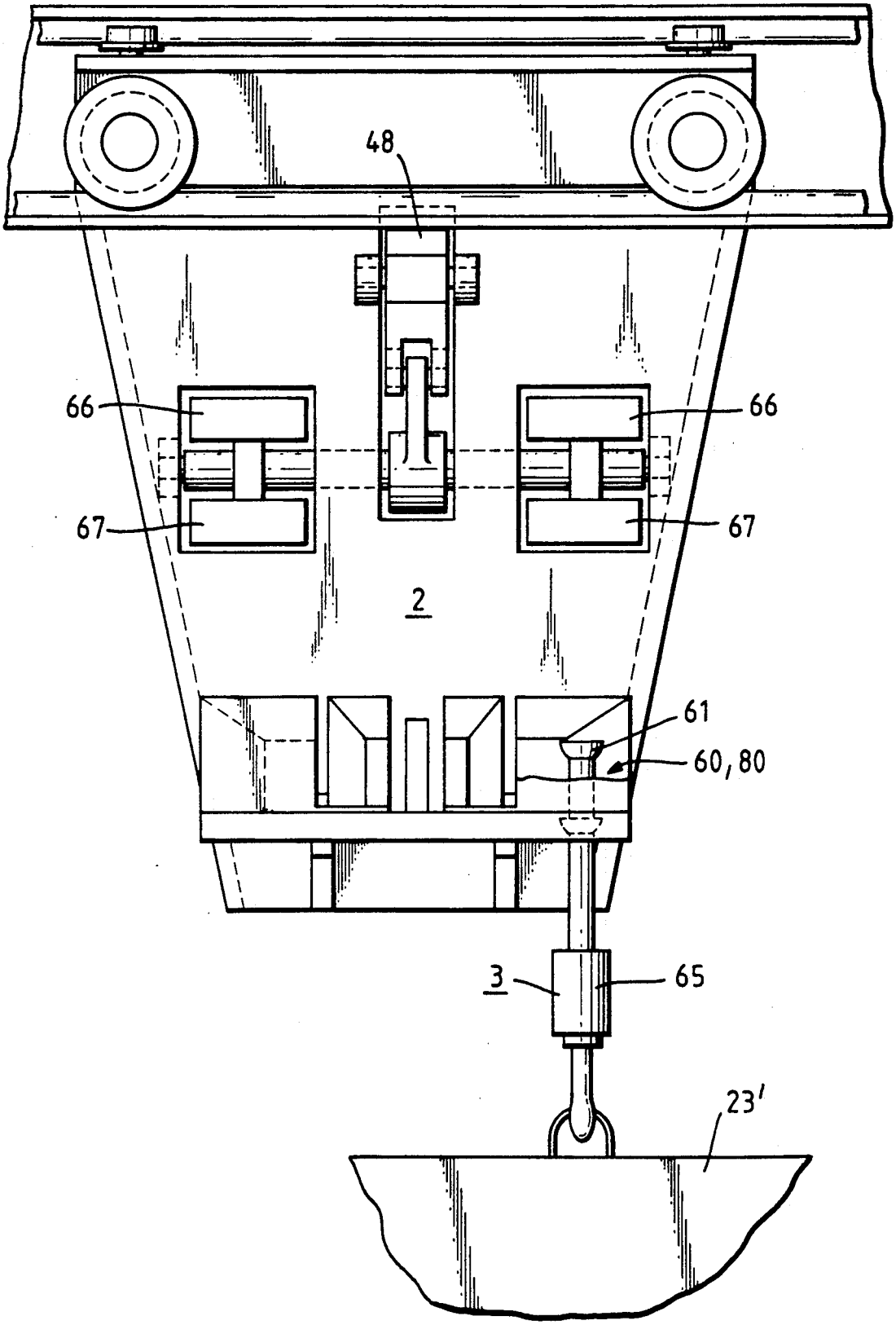
FIG. 3 is a sectional view of a suspension member of displaceable type taken along the line D—D in FIG. 1.
Figure 4:
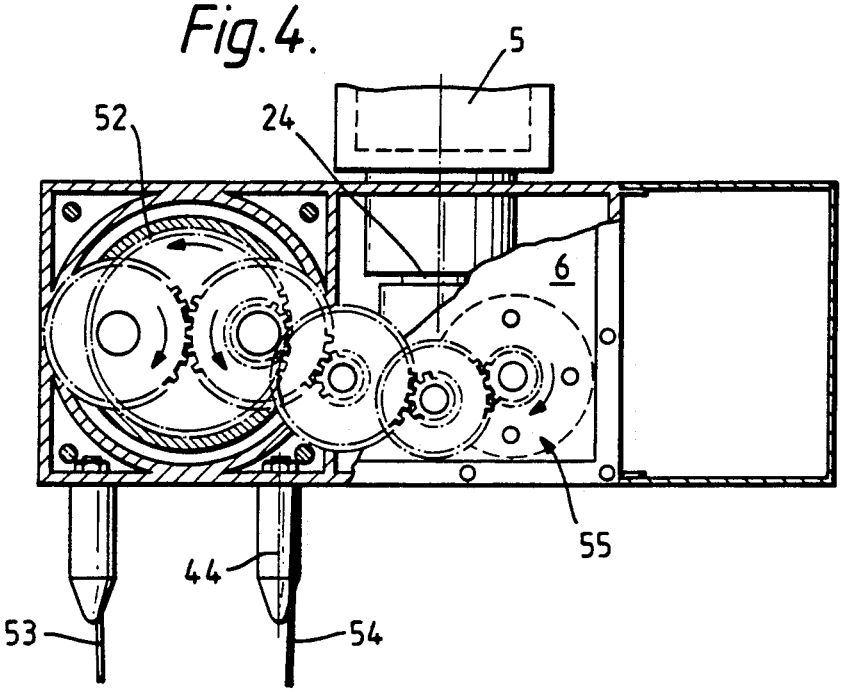
FIG. 4 is an end view of the hoist part of the conveyor carriage seen as mirror image of the section taken along the line C—C in FIG. 2.

The friction bearing catch 48 is needed in a displaceable suspension member 2 in order that the suspension member should not be able to move when the hook unit is being placed into its position or removed. The brake catch 48 is closed and opened by the intermediate of the pressure faces 66, 67 (FIG. 3) by means of activation pins 46, 47 (FIG. 1), which are controlled, as the other functions of the conveyor carriage are also controlled, from the floor plane, e.g., by means of an infrared remote controller.

Excessive turning of the transfer wheel sets 9, 10 is prevented by means of a mechanical stop, which is not shown in the accompanying figures, as are not the microswitches that detect the positions of the transfer wheel sets. The conveyor carriage 1 receives its operating power from conductor rails 68. The current collectors 70, 71 are placed at both sides of the conveyor carriage 1. One conductor in the current collectors 70 and 71 is provided exclusively for ensuring that the positions of the transfer wheel sets can be altered only if there is a live counter-conductor rail at the other side.

Figure 12:
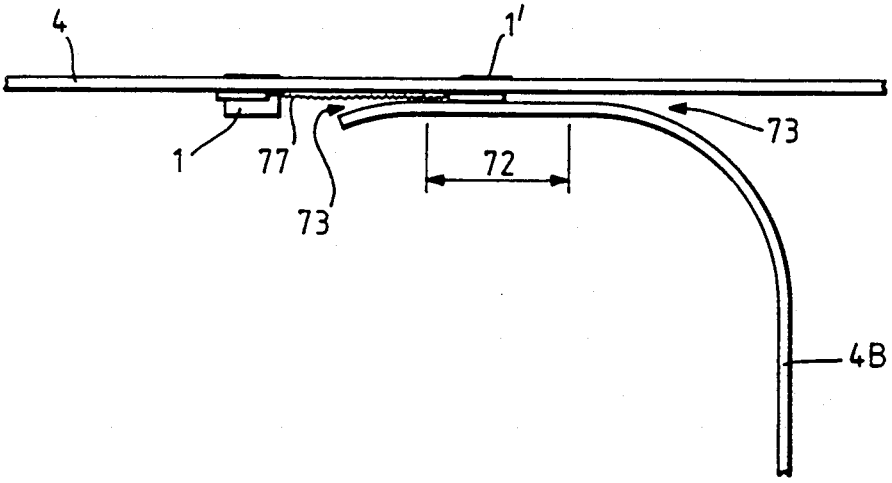
FIG. 12 shows a track-exchange area in the track.
Figure 14:
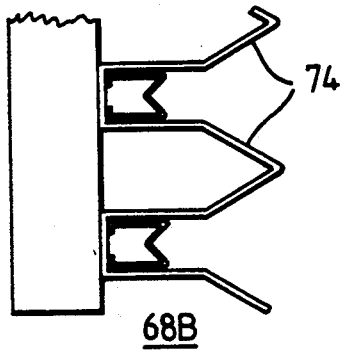
FIG. 14 shows guides of the current supply rail at the junction point in a track-exchange area.

In the meeting zones 73 (FIG. 12) in the track-exchange areas 72, the conductor rails 68B must be provided with guides 74 as shown in FIG. 14 to make sure that the current collectors 70, 71 meet the conductor rails.

In the meeting zones 73 in the track-exchange areas 72, the tracks 4, 4B are provided with additional rigidifiers 89 (FIG. 15) in order to improve the accuracy of alignment of the transfer wheel set 8, 10 by reducing the lateral swinging of the conveyor carriage 1.

Figure 15:
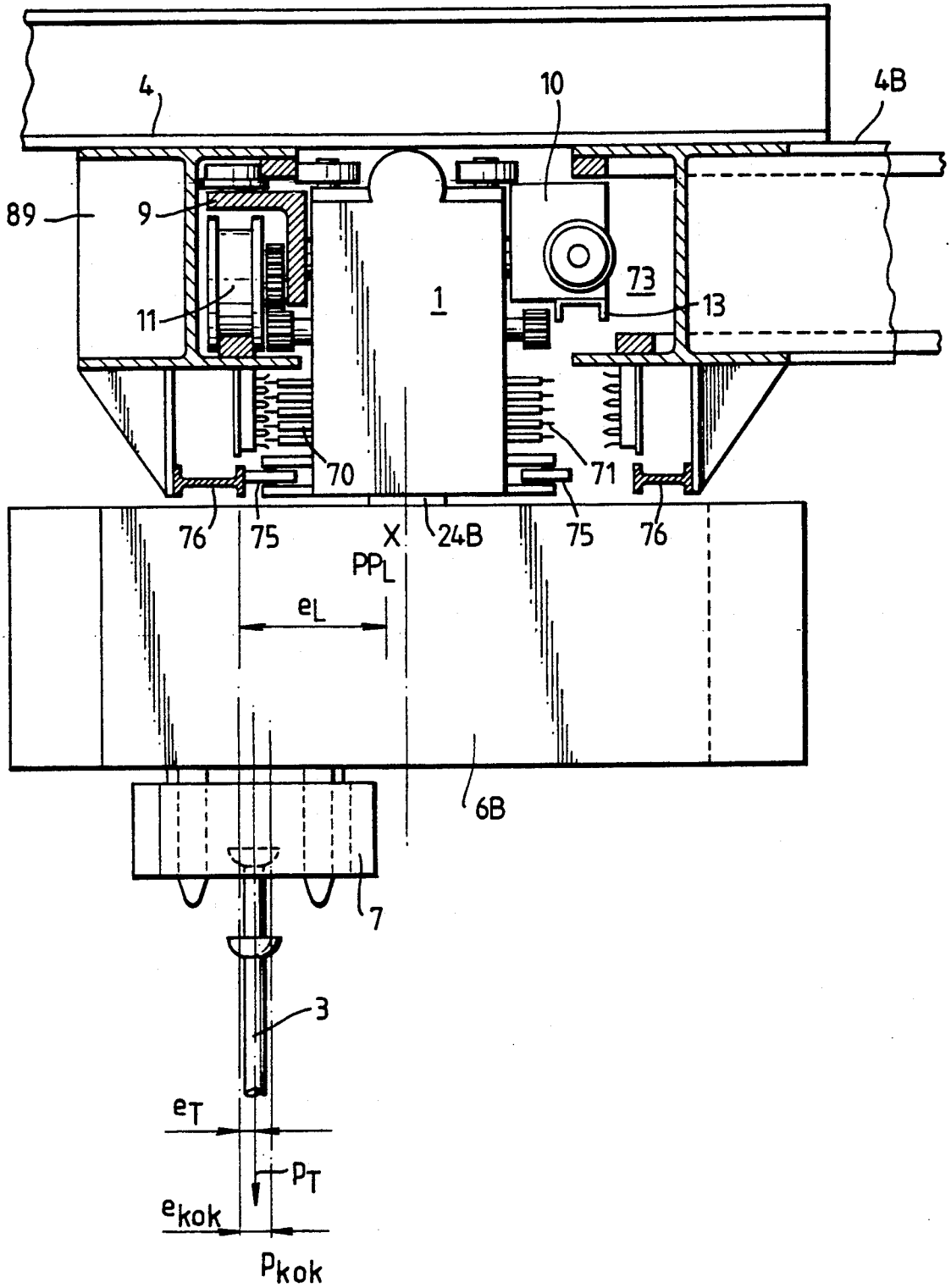
FIG. 15 is an end view of an embodiment of a conveyor carriage in the junction zone of a track-exchange area.

If necessary, the conveyor carriage 1 may be provided with auxiliary wheels 75, and the meeting zones may be provided with corresponding auxiliary rails 76 (FIG. 15). These increase the stability of the conveyor carriage 1 in respect of lateral swinging if the vertical line $P_{kok}$ passing through the centre of gravity of the unit constituted by the load and by the conveyor carriage is placed inside the support area $e_{kok}$ formed by the carrying wheels 11 or 13 and the lower guide rails 19 or 20. This is achieved either by means of constructional dimensioning of the conveyor carriage 1 or by running the hoist unit 6 of the conveyor carriage 1 into the meeting zone 73 in a partly turned position (FIG. 15). In such a case, a possibility of individual rotation of the hoist unit 6 (FIGS. 16 and 17) is indispensable.

Figure 9:
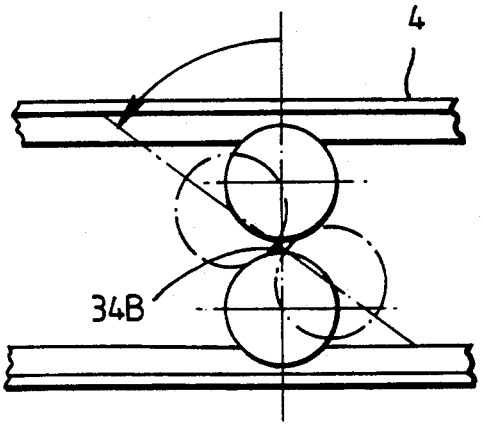
Figure 10:
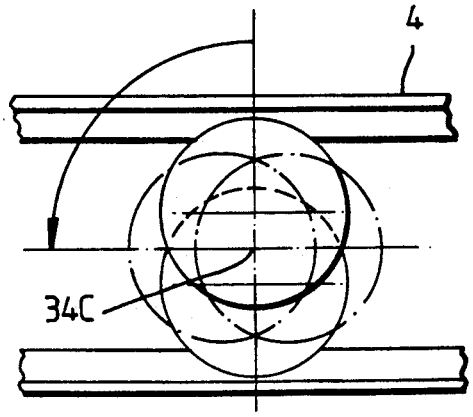

A lockable transfer wheel set 9, 10 may be accomplished in a number of different ways; FIGS. 9 and 10 show a couple of examples. In FIG. 9 the wheels are in the same vertical plane. In FIG. 10 they are in different planes. The transfer wheel sets with their guide rails may also be similar to the wheel set/rails in the system in accordance with the patent EP 0,110,196 (U.S. Pat. No. 4,561,359).

Figure 19:
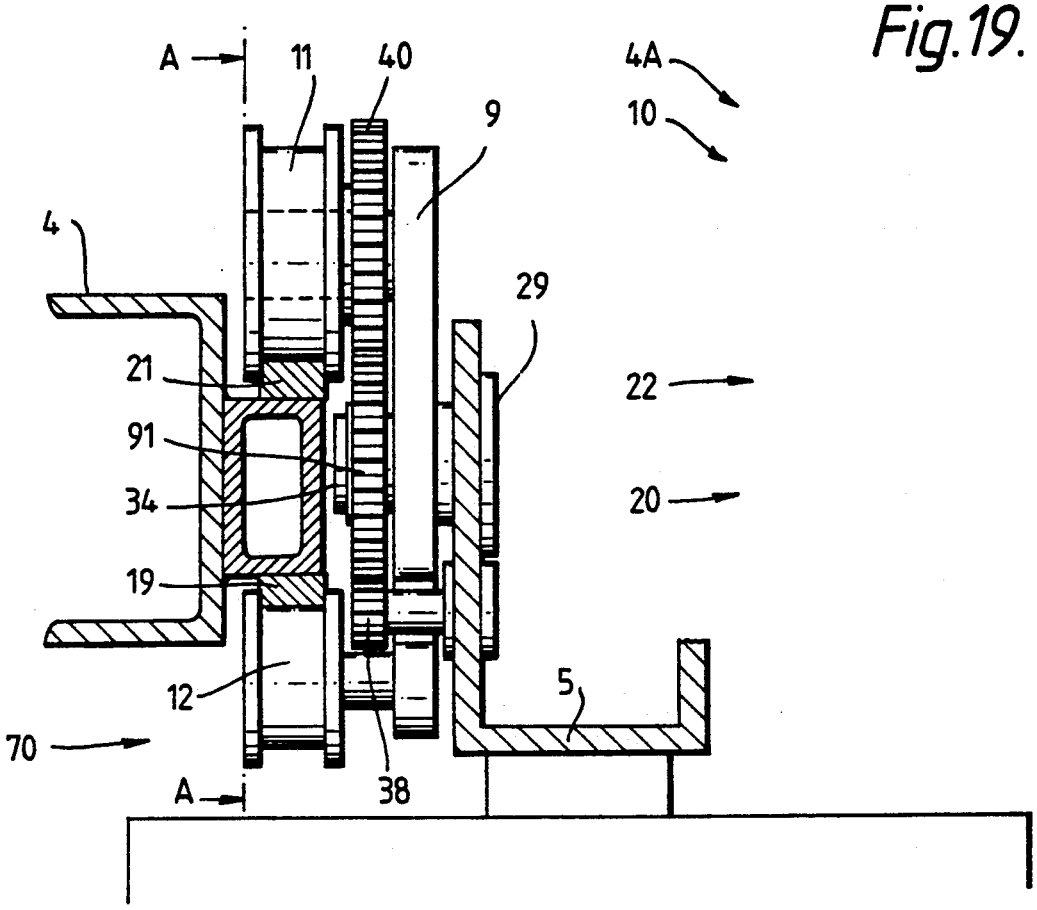
FIG. 19 shows such a set of transfer wheels in a projection in accordance with FIGS. 1, 15 and 18 whose detached/closed positions are inverse to the detached/-closed positions of the sets of transfer wheels shown in FIGS. 1, 8, 9, 10, 15, 17, and 18.
Figure 20:
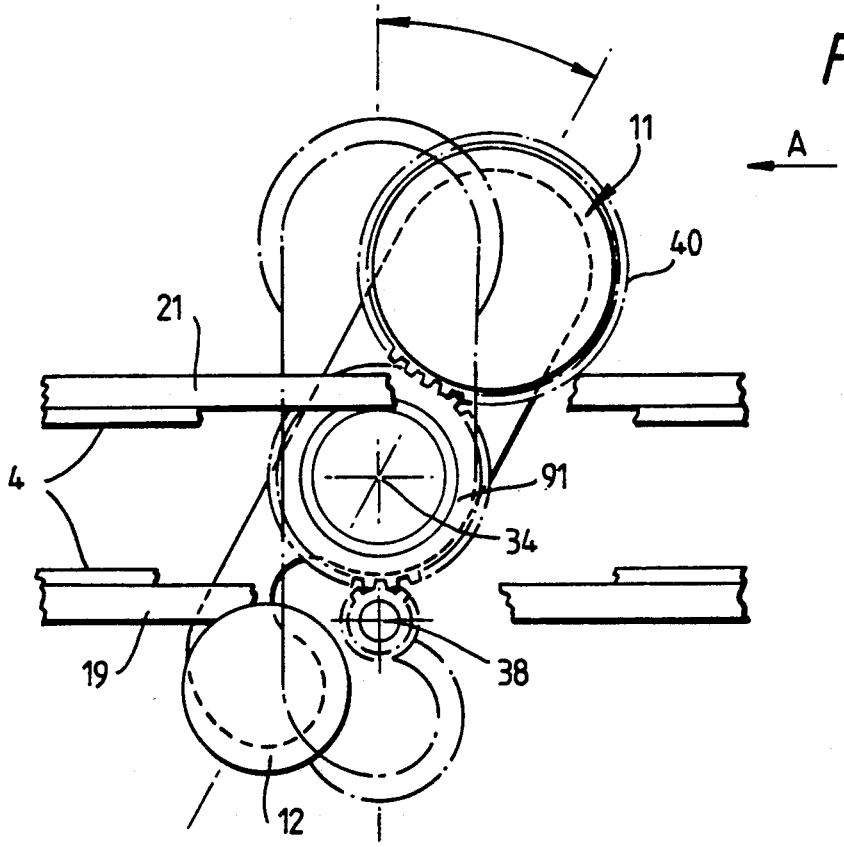
FIG. 20 is a sectional view taken along the line A—A in FIG. 19.

It is a feature common of the transfer wheel sets shown in FIGS. 1, 8, 9, 10, 15, 17, and 18 that therein the guide rails 19 and 21 as well as 20 and 22 are outside the individual wheels 11 and 12 as well as 13 and 14 in their transfer wheel sets. In the solution as shown in FIGS. 19 and 20 the same function is accomplished by means of a reversed arrangement; therein the guide rails 19 and 20 are inside the individual transfer wheels 11 and 12. Both of the wheels 11, 12 in the wheel set 9 are journalled on parallel horizontal shafts. In the grasping position, the upper wheel 11 is in its lower position in contact with the upper face of the upper guide rail 21, and the lower wheel 12 is in its upper position in contact with the lower face of the lower guide rail 19. When the wheel set is turned, the wheels 11 and 12 are detached from their guide rails, whereby the wheel set can be shifted laterally in relation to the track. An arrangement in accordance with FIGS. 19 and 20 is suitable in particular for loads of relatively low weight.

In a situation of operation, the load 23 is lifted, e.g., from below onto the suspension member 2 by means of the hoist unit 6 and the hook unit 3 of the conveyor carriage 1 while the hook unit 3 remains, along with the load 23, supported on the safety grasp 8 of the suspension member 2 until the load 23 is shifted from the suspension member 2, at a later stage, onto the support of another suspension member, and finally the load 23 alone, by means of other methods, out of the area while the suspension member 2 returns during the return movement of the conveyor carriage 1 back to the initial end of the process.

Figure 11:
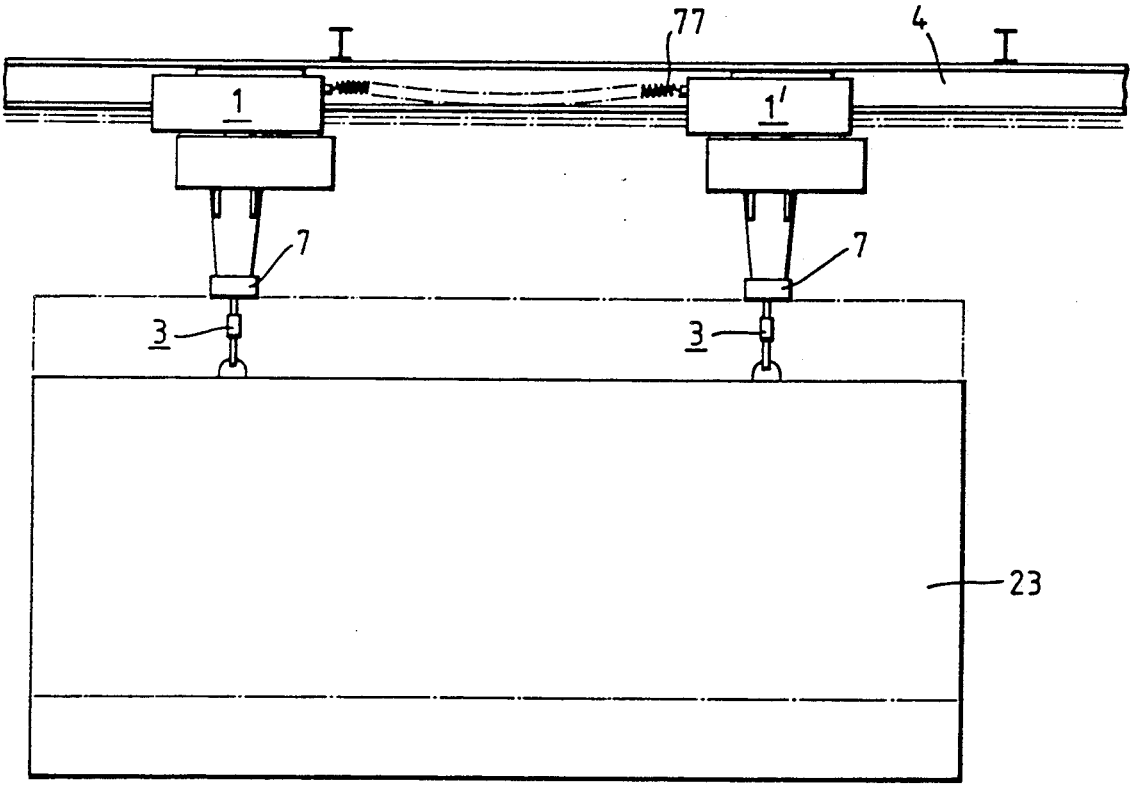
FIG. 11 shows two coupled conveyor carriages with a load suspended from two points.

It is advantageous to construct as many of the suspension members 2 as possible as stationary, without wheels, in which case no friction brake catch 48 is needed. In principle, a displaceable suspension member 2 is needed in two-point suspension applications in accordance with FIG. 11 only, in which case one suspension member may be stationary and the other suspension member 2, of displaceable type, is always displaced by pushing it by means of the conveyor carriage 1 so that it is suitable for the necessary suspension spacing. As the pushing buffer between the conveyor carriage 1 and the displaceable suspension member 2, it is possible to employ the hook unit 3, the safety grasper 7 of the conveyor carriage as such, or the activation pin 47 that performs the opening of the brake catch 48 as inserted into a recess in the pressure face 67 provided on the suspension member 2. If the load 23' is suspended on displaceable suspension members 2 only, by means of the conveyor carriage 1 it is possible to transfer the suspension members 2 with their loads 23' in the track portions in which a transfer free of track switch from one track 4 to the adjoining track 4B is not required and in which there are the tracks 4 and 4A. Out of reasons of safety, changes in the positions of the transfer wheel sets 9, 9'; 10, 10' in the track exchange area 72 take place when the conveyor carriage is immobile. Only when the microswitch (not shown in the accompanying drawings) is activated as a result of a change in position is it possible to run further.

Figure 16:
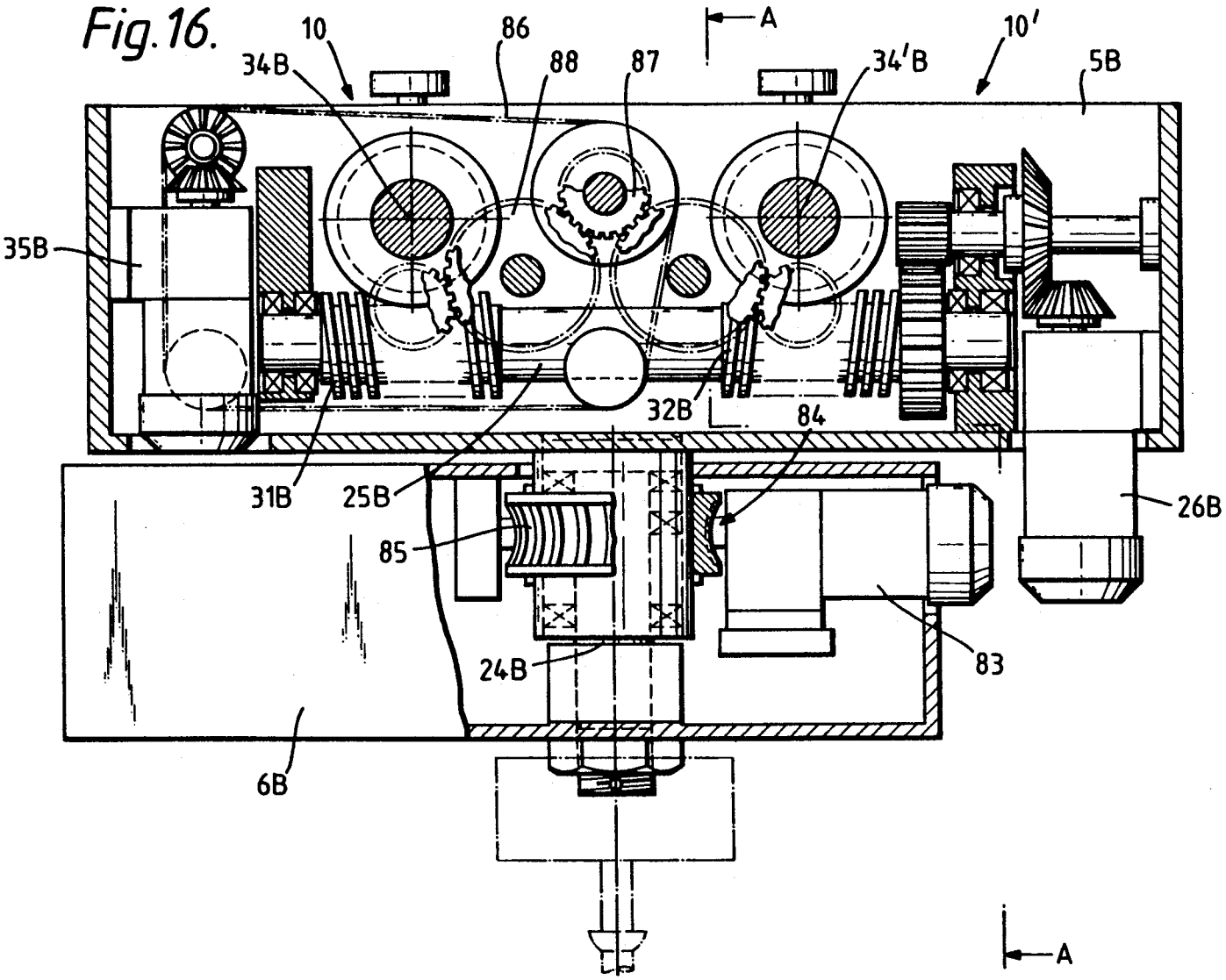
FIG. 16 is a longitudinal sectional view of a conveyor carriage wherein the alteration of the positions of the sets of transfer wheels and the turning that constitutes the transverse shifting of the hoist unit are carried out by means of separate motors.
Figure 17:
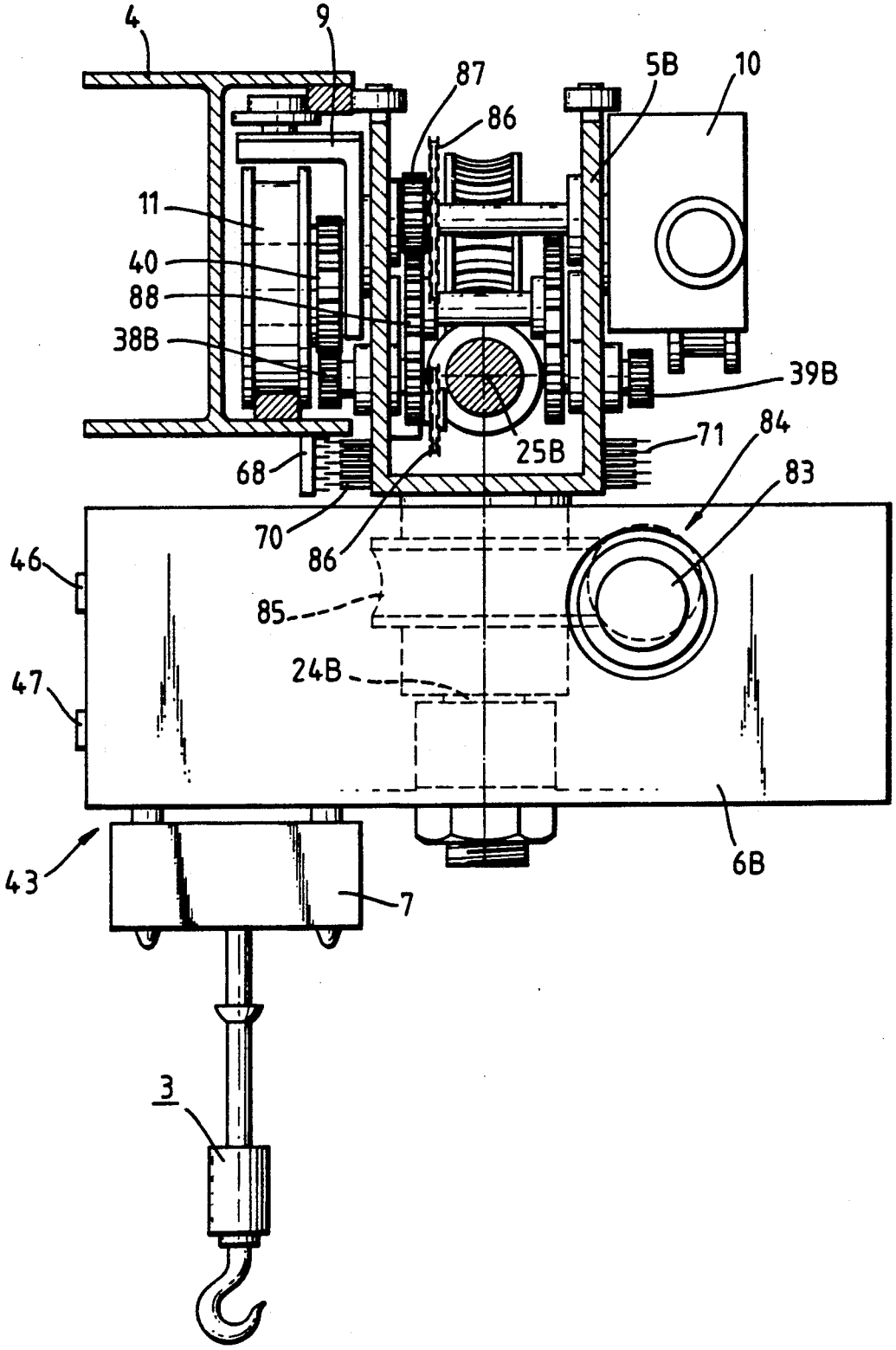
FIG. 17 is a sectional view taken along the line A—A in FIG. 16.
Figure 18:
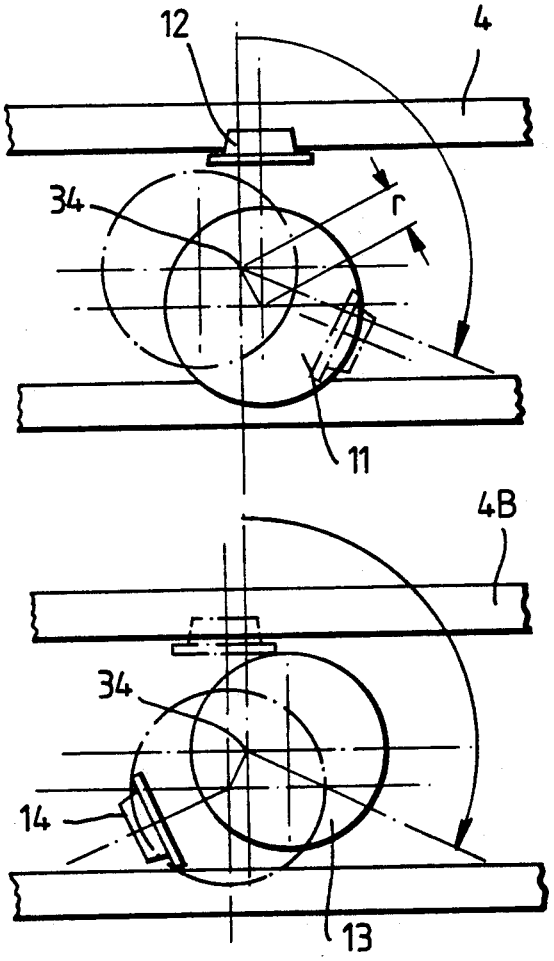
FIG. 18 shows positions of the wheel sets in a conveyor carriage in accordance with FIG. 8 when the alteration of the position of the wheel set is carried out by means of a movement of rotation by 120°.

In the embodiment shown in FIGS. 16 and 17, the turning of the hoist unit 6 around the vertical shaft 24 over 180° is performed by an electric switching motor 83 of its own, whose worm 84 is in engagement with a stationary worm wheel 85 provided in the transfer unit 5. Chain transmission 86 and cogwheels 87, 88 are provided for the purpose of transfer.

In the exemplifying embodiments in accordance with FIGS. 1, 2, 8, 15, 16, and 17, wherein the changes in the positions of the transfer wheel sets 9, 9'; 10, 10' are carried out by rotating a shaft 34, 34', which is eccentric in relation to the wheels 11, 11', 13, 13' which carry the wheel set of the type described, over 90° back and forth, the conveyor carriage 1 "bobs" 1-V2/2, i.e. about 29% of the amount of eccentricity r, in connection with change of track. The turning mechanisms of the transfer wheel sets 9, 9'; 10, 10' can also be constructed such that the transfer wheel sets 9, 9' at one side are not opened until the transfer wheel sets 10, 10' at the other side have been locked. From the practical point of view, a simple solution for the use of a transfer wheel set in accordance with FIGS. 1, 2, 8, 15, 16, and 17 is obtained by rotation of the shaft 34 over 120° (FIG. 18), in which case the "bobbing" is only 13% of the amount of eccentricity r.

Figure 21:
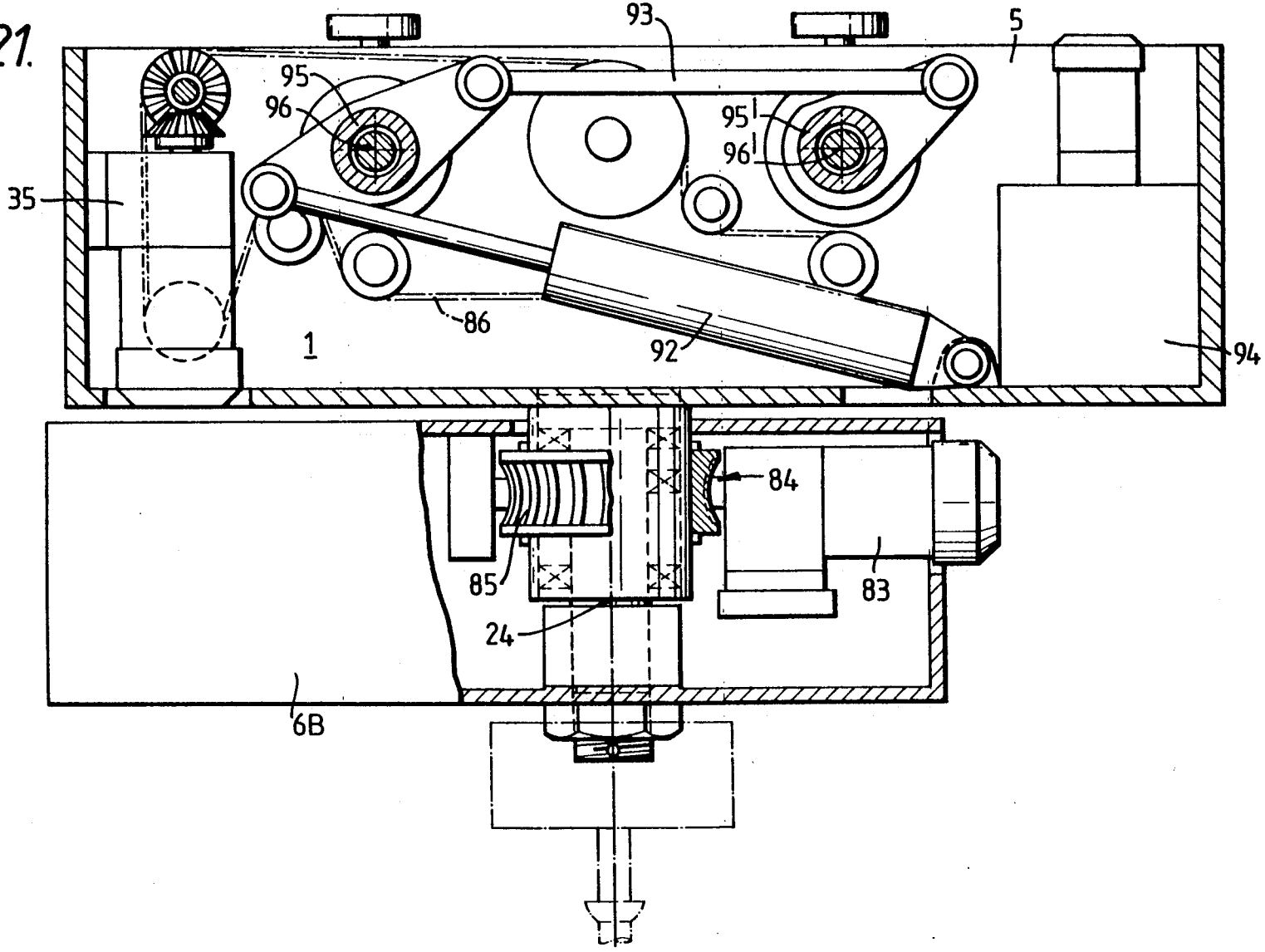
FIG. 21 is a sectional view corresponding to FIG. 16 of such an embodiment of a conveyor carriage wherein the positions of the sets of transfer wheels placed side by side at different sides are altered by means of hydraulic cylinders of each side's own independently from one another.

Said "bobbing" is avoided completely, for example, by means of a solution in accordance with FIG. 21. Therein the transverse shafts 95, 95', 96, 96' of rotation do not continue in a way transferring the torque from one side to the other, but they are in such a way cut-off that the positions of the transfer wheel sets at each side can be changed independently from one another by means of hydraulic cylinders 92 of their own (in FIG. 21 only the hydraulic cylinder 92 at the first side is seen, while the corresponding cylinder at the other side is placed symmetrically alongside the former cylinder). The shafts 95, 95' of rotation of the transfer wheel sets at the same side can be interconnected by means of a crank 93, in which case only one cylinder 92 of rotation is needed per side. The part 94 is a hydraulic pump unit. Thus, when a solution in accordance with FIG. 21 is used, in connection with change of track, the transfer wheel sets placed at the side of the second track 4a, 4B can be closed before the transfer wheel sets placed at the side of the first track 4 are opened. The shaft ends 96, 96' at the second side are inserted partly into the shafts 95, 95' at the first side for the purpose of increasing the bending rigidity. The chain transmission 86 (FIG. 21), which effects the movement of the conveyor carriage 1 in the direction of the track by the intermediate of carrying wheels, is placed as an extreme part at the first side.

The grasping points 60, 61 of the hook unit, placed one above the other, are shaped as spherical caps, which permits a slight lateral turning without producing a bending strain on the grasping joint formed by the cap housing 80, 61 and the grasping point 60, 61.

Figure 13:
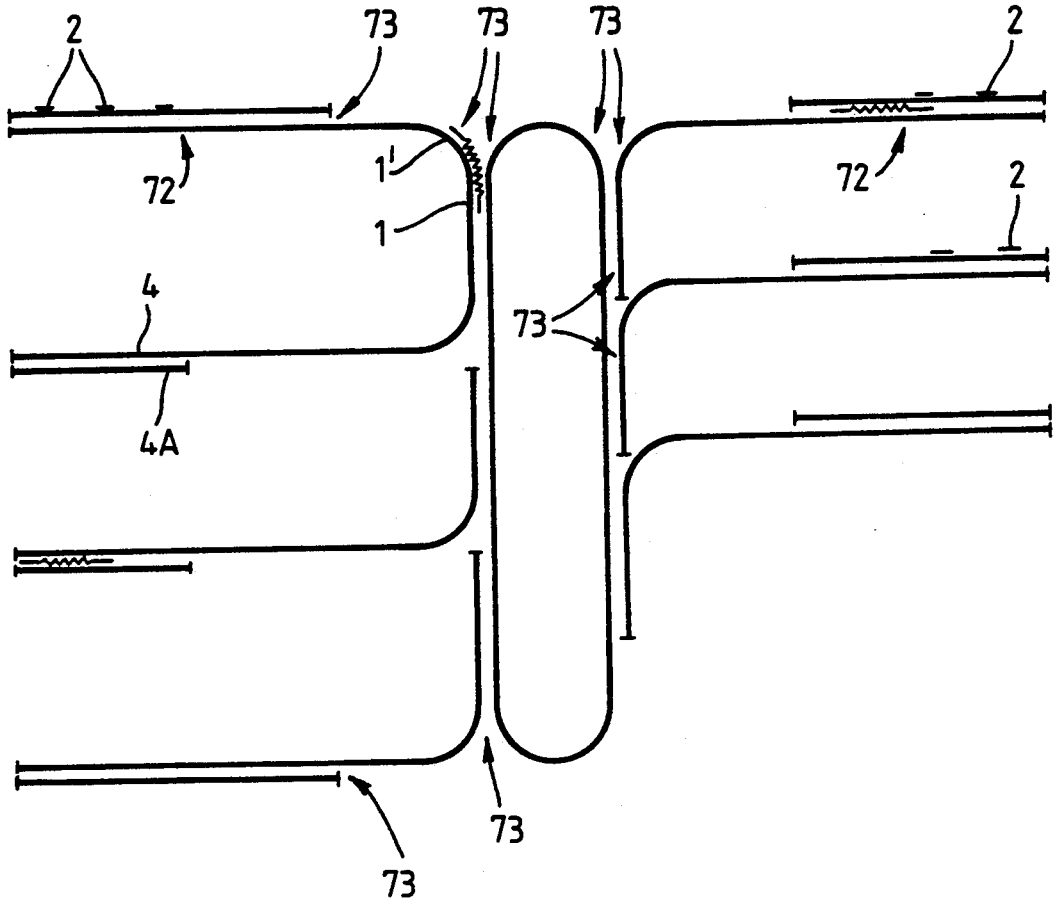
FIG. 13 shows the whole of a track lay-out.

The track network free of switches for the overhead suspension system in accordance with the present invention, which is functionally equivalent of several electromechanical switches, is specific for each application and can be carried into effect in a number of ways, whose more detailed discussion is to be considered separately. The accompanying FIG. 13 shows one exemplifying embodiment.

What is claimed is:

1. A method for transferring an overhead conveyor carriage having two sets of transfer wheels with carrying wheels from a first track onto a second track arranged at a specified distance parallel to said first track by altering height positions of said sets of transfer wheels on the conveyor carriage in relation to the tracks comprising the steps of:

detaching and raising one wheel set in a carrying position on the first track from the first track; and lowering and attaching the other set into the carrying position on the second track.

2. A method as claimed in claim 1 further comprising the step of interchanging the height positions of the transfer wheel sets by rotating said wheel sets about a horizontal shaft which is eccentric in relation to an axis of rotation for each of the wheel sets.

3. A method as claimed in claim 1 further comprising the step of shifting a center of gravity of the conveyor carriage and a load supported by the conveyor carriage in a transverse direction from beside the first track to a corresponding point beside the second track.

4. A method as claimed in claim 3, wherein said shifting step transfers the load by turning a part of the conveyor carriage about a vertical shaft.

5. An overhead conveyor system, comprising:

at least one conveyor carriage provided with sets of transfer wheels including carrying wheels;

a first track having guide rails with running faces thereon;

a second track, also having guide rails with running faces thereon, said second track placed parallel to said first track at a certain distance from said first track; and means for alternating height positions of the sets of transfer wheels such that the sets can be alternated between a grasping position and a detached position.

6. An overhead conveyor system as claimed in claim 5, wherein said transfer wheel sets on opposite sides of the conveyor carriage are attached eccentrically onto a common transverse shaft of rotation.

7. An overhead conveyor system as claimed in claim 5, wherein the transfer wheel sets on the same side of the conveyor carriage are attached eccentrically onto several transverse shafts of rotation so that the height positions of transfer wheel sets on one side of the carriage can be changed independently from the height positions of transfer wheel sets on the opposite side of the carriage.

8. An overhead conveyor system as claimed in claim 5, further comprising means, displaceable perpendicular to a track, for supporting a load.

9. An overhead conveyor system as claimed in claim 8, wherein said supporting means further comprises a vertical shaft about which said carriage may rotate; and means for suspending said load eccentrically from said vertical axis of rotation of the carriage.

10. An overhead conveyor system as claimed in claim 8, wherein said supporting means further comprises means to transfer said load far enough perpendicular to a track that a gap remains between the load suspended from the support means and another load suspended from a suspension unit on the same track.

11. An overhead conveyor system as claimed in claim 8, wherein said supporting means further comprises means to transfer said load to a suspension unit placed alongside a track.

12. An overhead conveyor system as claimed in claim 5, further comprising a hook unit which can be detachably fitted to the support means of the conveyor carriage and also detachably fitted to a suspension unit.

13. An overhead conveyor system as claimed in claim 12 wherein both the support means and the suspension unit further comprise safety catches which can be opened when the support means and suspension unit are pushed towards each other.

14. A method as claimed in claim 2 further comprising the step of shifting a center of gravity of the conveyor carriage and a load supported by the conveyor carriage in a transverse direction from beside the first track to a corresponding point beside the second track.

15. An overhead conveyor system as claimed in claim 9, wherein said supporting means operates to transfer said load far enough perpendicular to a track that a gap remains between the load suspended from the support means and another load suspended from a suspension unit on the same track.

16. An overhead conveyor system as claimed in claim 9, wherein said supporting means further comprises means to transfer said load to a suspension unit placed alongside a track.

17. An overhead conveyor system as claimed in claim 10, wherein said supporting means further comprises means to transfer said load to a suspension unit placed alongside track.

18. An overhead conveyor system as claimed in claim 15, wherein said supporting means further comprising means to transfer said load to a suspension unit placed alongside a track.

* * * * *